US011279153B2

(12) United States Patent
Wakakusa et al.

(10) Patent No.: US 11,279,153 B2
(45) Date of Patent: Mar. 22, 2022

(54) IMAGE RECORDING APPARATUS AND PRINTER DRIVER

(71) Applicant: BROTHER KOGYO KABUSHIKI KAISHA, Nagoya (JP)

(72) Inventors: Keisuke Wakakusa, Nagoya (JP); Shohei Ichikawa, Kasugai (JP); Masatake Sato, Ichinomiya (JP); Yoshimitsu Taniguchi, Tajimi (JP); Tsuyoshi Ito, Nagoya (JP); Hiroaki Takahashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 206 days.

(21) Appl. No.: 16/793,533

(22) Filed: Feb. 18, 2020

(65) Prior Publication Data

US 2020/0277154 A1 Sep. 3, 2020

(30) Foreign Application Priority Data

Mar. 1, 2019 (JP) ..... JP2019-037556

(51) Int. Cl.

| | |
|---|---|
| ***B41J 13/00*** | (2006.01) |
| ***B65H 29/12*** | (2006.01) |
| ***B41J 11/04*** | (2006.01) |
| ***B65H 5/06*** | (2006.01) |

(52) U.S. Cl.

CPC ..... *B41J 13/0027* (2013.01); *B41J 11/04* (2013.01); *B65H 5/062* (2013.01); *B65H 29/12* (2013.01); *B65H 2403/72* (2013.01); *B65H 2513/106* (2013.01); *B65H 2557/242* (2013.01)

(58) Field of Classification Search

CPC ..... B41J 13/0027

See application file for complete search history.

(56) References Cited

U.S. PATENT DOCUMENTS

2008/0204495 A1* 8/2008 Ueno ..... B41J 11/008 347/14

FOREIGN PATENT DOCUMENTS

| | | | |
|---|---|---|---|
| JP | 4-158068 | A | 6/1992 |
| JP | 8-25727 | A | 1/1996 |
| JP | 2000-6489 | A | 1/2000 |
| JP | 2006-143442 | A | 6/2006 |
| JP | 2008-229886 | A | 10/2008 |

* cited by examiner

*Primary Examiner* — John E Breene
*Assistant Examiner* — Jeffrey C Morgan
(74) *Attorney, Agent, or Firm* — Merchant & Gould P.C.

(57) ABSTRACT

An image recording apparatus includes a roller pair for transporting a sheet, a recording head, and a controller. The controller determines a linefeed amount by which the sheet is transported by the roller pair between corresponding two adjacent passes of the recording head. The controller executes image recording on the sheet by alternately repeating a linefeed operation for rotating the roller pair by the determined linefeed amount to transport the sheet in a transport direction, and a pass recording operation in which the controller causes the roller pair to stop and the recording head to perform a pass and to record part of an image on the sheet. Upon determining that a linefeed operation would cause the sheet to travel past the roller pair while the roller pair is decelerating, replace for the linefeed operation a determined linefeed amount by an adjusted linefeed amount.

21 Claims, 10 Drawing Sheets

CONTROLLER
130
CPU
131
ROM
132
RAM
133
EEPROM
134
137
ASIC
135
TRANSPORT MOTOR
102
DRIVE TRANSMISSION MECHANISM
70
SENSOR
120
SENSOR
124
ROTARY ENCODER
121
CARRIAGE MOTOR
103
PIEZOELECTRIC ELEMENT
50
FEED ROLLERS
25
TRANSPORT ROLLER
60
DISCHARGE ROLLER
62
CARRIAGE
23
RECORDING HEAD
39

IMAGE RECORDING APPARATUS AND PRINTER DRIVER

CROSS-REFERENCE TO RELATED APPLICATION

This application claims priority from Japanese Patent Application No. 2019-037556 filed on Mar. 1, 2019, the content of which is incorporated herein by reference in its entirety.

TECHNICAL FIELD

Aspects of the disclosure relate to an image recording apparatus configured to record an image on a sheet, and to a printer driver configured to send print data to an image recording apparatus.

BACKGROUND

A known image recording apparatus includes a recording unit, a transport roller pair, and a discharge roller pair. The transport roller pair is disposed upstream of the recording unit in a transport direction of a sheet to transport the sheet toward the recording unit. The discharge roller pair is disposed downstream of the recording unit in the transport direction to discharge the sheet with an image recorded thereon to an exterior of the image recording apparatus.

The sheet subjected to image recording is pinched by both the transport roller pair and the discharge roller pair. As image recording progresses, a leading edge of the sheet in the transport direction travels past the transport roller pair. Thereafter, the rest of the image is recorded onto the sheet which is pinched only by the discharge roller pair.

The moment the sheet travels past the transport rollers in pair, the transport rollers which have been spaced from each other by the sheet are brought into contact with each other. In this case, an instantaneous force applies from the transport rollers to the sheet in the transport direction. This may instantaneously increase the transport amount of the sheet and cause an error in the transport amount of the sheet.

In another known image recording apparatus, in order to reduce a variation, among sheets, of errors in the transport amount during intermittent sheet transport, a sheet is stopped at a fixed position immediately before the sheet travels past a transport roller pair.

SUMMARY

Stopping a sheet at a fixed position as in the known apparatus may reduce a variation, among sheets, of errors in the transport amount of a sheet travelling past the transport roller pair, but this may not reduce an error in the transport amount of a sheet travelling past the transport roller pair, thereby disadvantageously affecting the quality of an image on the sheet.

Stopping a sheet at a fixed position as in the known apparatus may reduce the sheet transport amount immediately before the sheet travels past the transport roller pair, causing extension of the time required for completing image recording on the sheet and thus impeding high-speed image recording.

Aspects of the disclosure provide an image recording apparatus and a printer driver which may advantageously reduce an error in the transport amount of a sheet traveling past a transport roller pair, and prevent extension of the time required for image recording on the sheet.

According to one or more aspects of the disclosure, an image recording apparatus includes a roller pair configured to pinch and transport a sheet; a recording head; and a controller. The controller is configured to: determine, based on print data, a linefeed amount by which the sheet is transported by the roller pair between corresponding two adjacent passes of the recording head; execute image recording on the sheet by alternative repeating a linefeed operation in which the controller causes the roller pair to rotate by the determined linefeed amount to transport the sheet in a transport direction, and a pass recording operation in which the controller causes the roller pair to stop and the recording head to perform a pass and to record part of an image on the sheet; identify, out of a plurality of linefeed operations, a linefeed operation that would cause the sheet to travel past the roller pair in the event that the roller pair rotates by the determined linefeed amount; determine whether the identified linefeed operation would cause the sheet to travel past the roller pair while the roller pair is decelerating; and upon determining that the identified linefeed operation would cause the sheet to travel past the roller pair while the roller pair is decelerating, determine for the identified linefeed operation an adjusted linefeed amount to replace the determined linefeed amount, such that the sheet to be transported by the adjusted linefeed amount in the identified linefeed operation does not travel past the roller pair and that the sheet to be transported, in a linefeed operation next to the identified linefeed operation, travels past the roller pair while the roller pair is not decelerating.

According to one or more other aspects of the disclosure, a printer driver is executable on an external device communicatively connected to an image recording apparatus. The printer driver is executable to: generate print data which includes image data to be recorded on a sheet by passes of a recording head of the image recording apparatus, and linefeed amounts by each of which the sheet is transported by a roller pair of the image recording apparatus between corresponding previous and next passes of the recording head; determine each of the linefeed amounts based on image data for a corresponding next pass of the recording head; identify, out of a plurality of linefeed operations, a linefeed operation that would cause the sheet to travel past the roller in the event that the roller pair rotates by the determined linefeed amount; upon determining that the identified linefeed operation would cause the sheet to travel past the roller pair while the roller pair is decelerating, replace for the identified linefeed operation a determined linefeed amount by an adjusted linefeed amount; and determine the adjusted linefeed amount such that the sheet to be transported by the adjusted linefeed amount in the identified linefeed operation does not travel past the roller pair and that the sheet to be transported in a linefeed operation next to the identified linefeed operation travels past the roller pair while the roller pair is not decelerating.

According to one or more further aspects of the disclosure, a method of generating print instructions useable by an image recording apparatus includes: generating print data which includes image data to be recorded on a sheet by passes of a recording head of the image recording apparatus, and linefeed amounts by each of which the sheet is transported by a roller pair of the image recording apparatus between corresponding previous and next passes of the recording head; determining each of the linefeed amounts based on image data for a corresponding next pass of the recording head; identifying, out of a plurality of linefeed operations, a linefeed operation that would cause the sheet to travel past the roller pair in the event that the roller pair rotates by the determined linefeed amount; upon determining that the identified linefeed operation would cause the sheet to travel past the roller pair while the roller pair is decelerating, replacing for the identified linefeed operation a determined linefeed amount by an adjusted linefeed amount; and determining the adjusted linefeed amount such that the sheet to be transported by the adjusted linefeed amount in the identified linefeed operation does not travel past the roller pair and that the sheet to be transported in a linefeed operation next to the identified linefeed operation travels past the roller pair while the roller pair is not decelerating.

DETAILED DESCRIPTION

Figure 1:
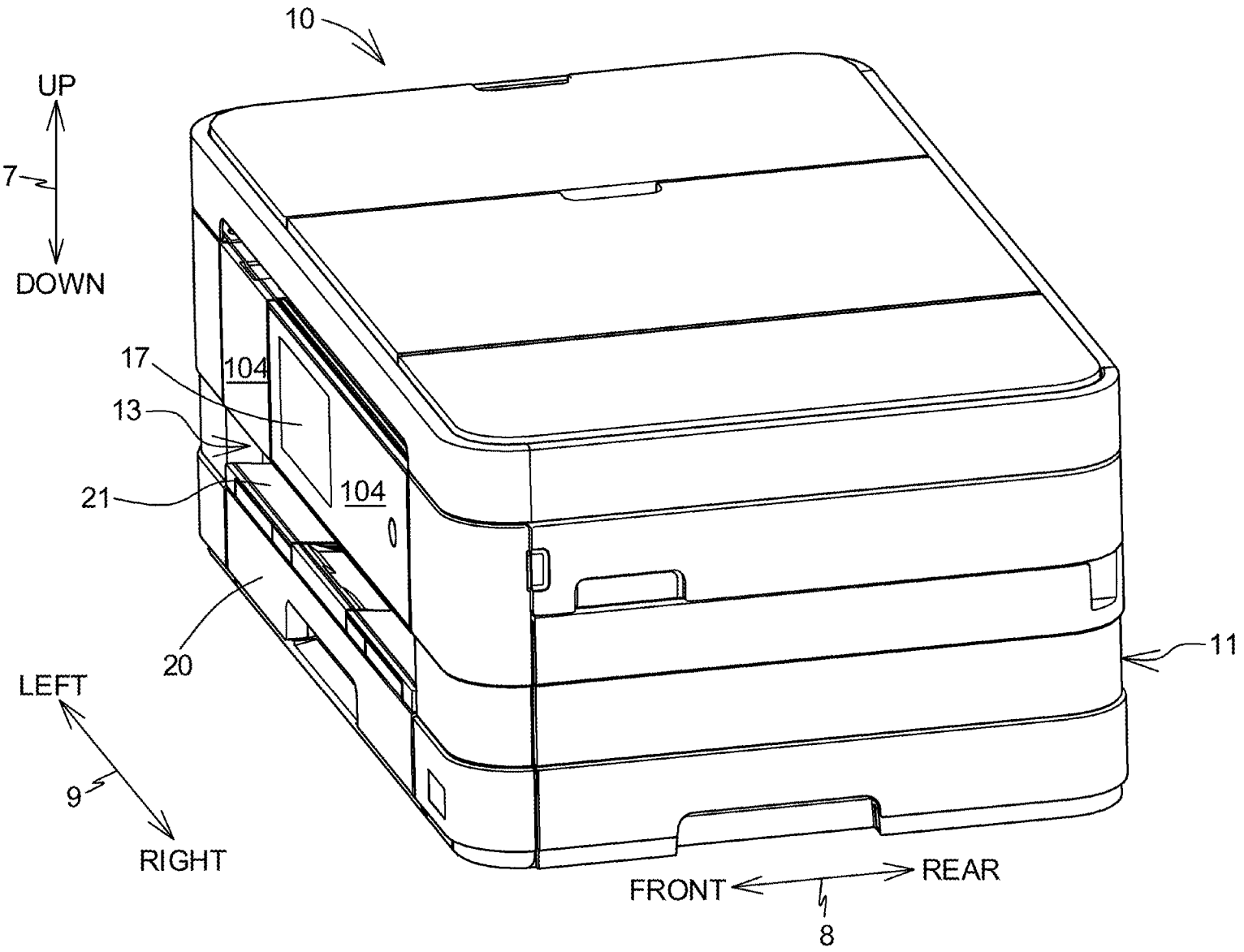
FIG. 1 is a perspective view of a multifunction device according to an illustrative embodiment.

An illustrative embodiment of the disclosure will now be described with reference to the drawings. While the disclosure will be described with reference to a specific embodiment, this is merely an example, and various changes may be made therein, without departing from the spirit and scope of the disclosure. In the following description, an up-down direction 7 may be defined in conjunction with an orientation in which a multifunction device 10 is intended to be used, as shown in FIG. 1. A side of the multifunction device 10 having an opening 13 may be defined as a front side 104. A front-rear direction 8 may be defined in conjunction with the front side 104. A left-right direction 9 may be defined in conjunction with the multifunction device 10 as viewed from the front side 104. The up-down direction 7, the front-rear direction 8, and the left-right direction 9 are orthogonal to each other. In this embodiment, the up-down direction 7 is a vertical direction while the front-rear direction 8 and the left-right direction 9 are horizontal directions.

Overall Structure of Multifunction Device 10

As shown in FIG. 1, an image recording apparatus, e.g., the multifunction device 10, is substantially rectangular parallelepiped. The multifunction device 10 includes an inkjet printer 11 disposed at a lower portion thereof to record an image on a sheet 12 (refer to FIG. 2). The multifunction device 10 has various functions such as a facsimile function and a printing function.

Figure 2:
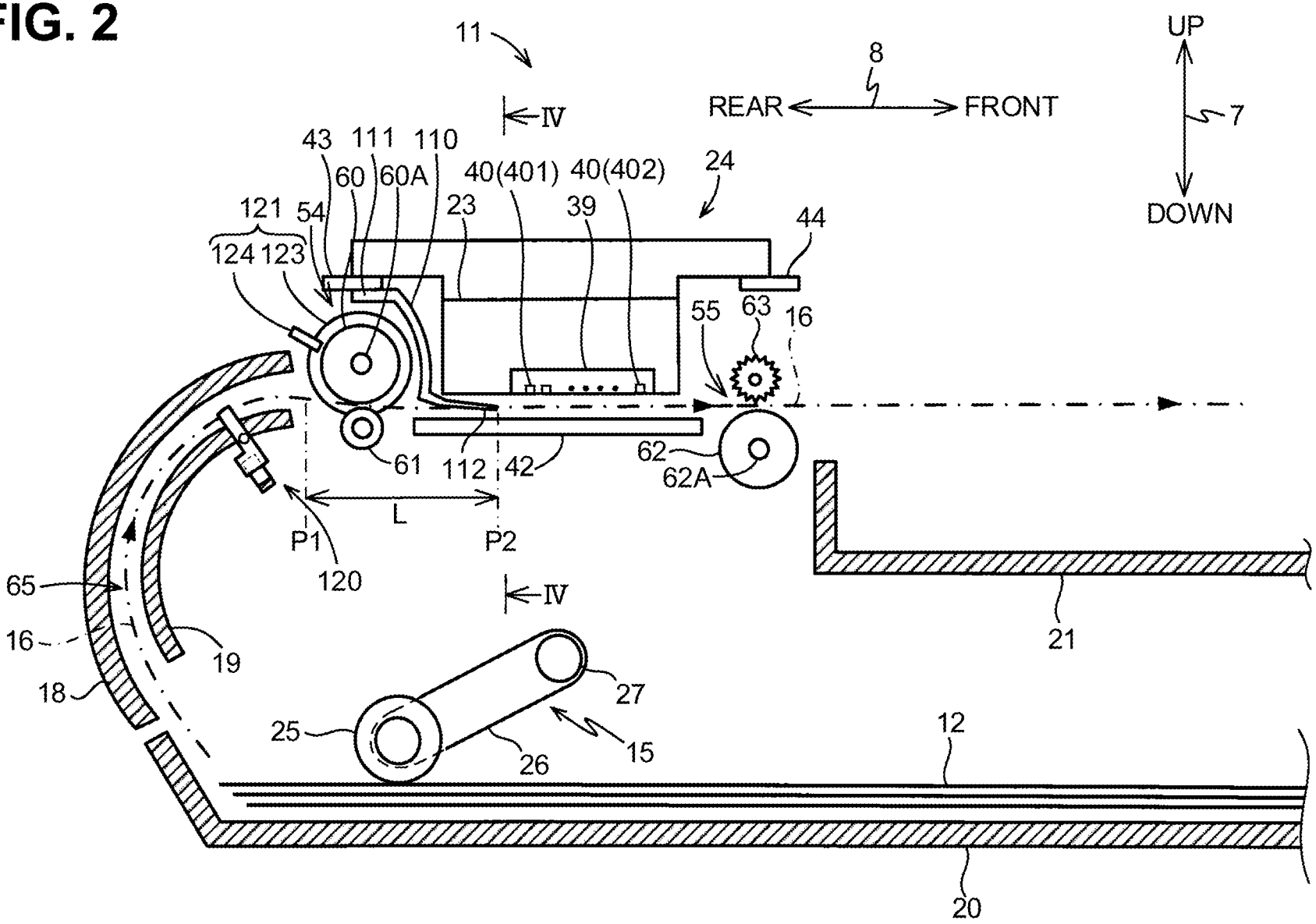
FIG. 2 is a vertical sectional view of a printer of the multifunction device, schematically showing an internal structure of the printer.
Figure 6:
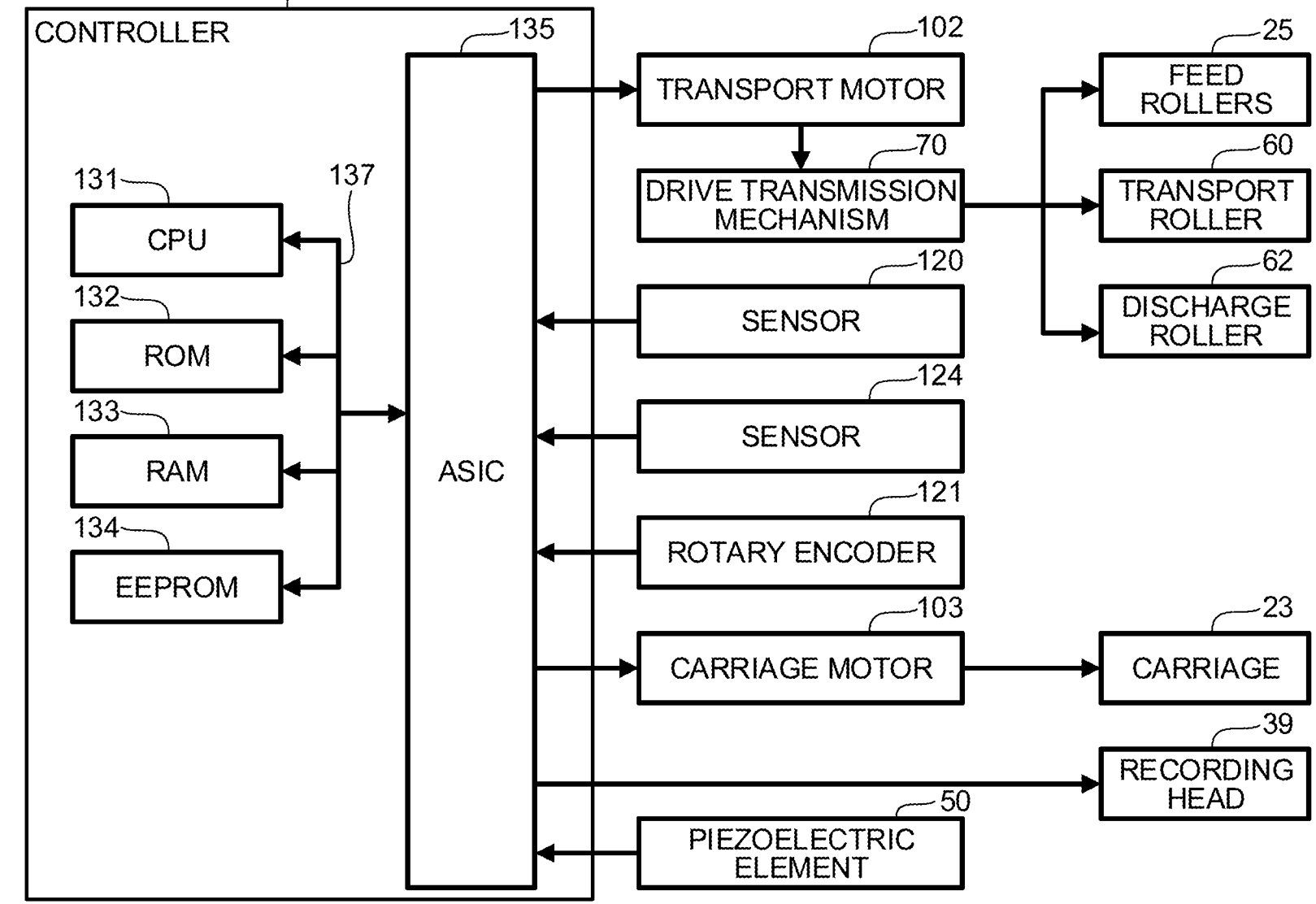
FIG. 6 is a functional block diagram of the printer.

As shown in FIG. 2, the printer 11 includes a feed tray 20, a discharge tray 21, a feeder 15, a transport roller pair 54, a discharge roller pair 55, a recording unit 24, a platen 42, contact members 110, a sensor 120, a rotary encoder 121, a drive transmitting mechanism 70 (refer to FIG. 6), and a controller 130 (refer to FIG. 6).

Feed Tray 20 and Discharge Tray 21

As shown in FIGS. 1 and 2, the feed tray 20 is inserted rearward and withdrawn frontward through the opening 13 formed at the front of the printer 11. The feed tray 20 supports a stack of sheets 12. The discharge tray 21 is disposed above the feed tray 20. The discharge tray 21 holds sheets 12 discharged by the discharge roller pair 55, through the opening 13.

Feeder 15

As shown in FIG. 2, the feeder 15 includes a feed roller 25, a feed arm 26, and a shaft 27.

The feed roller 25 is rotatably supported at a distal end of the feed arm 26. The feed roller 25 contacts a sheet 12 supported in the feed tray 20 or a support surface of the feed tray when there is no sheets 12 in the feed tray. The feed arm 26 is supported, at its base end, by a frame (not shown) of the printer 11 pivotably about the shaft 27.

The feed roller 25 rotates clockwise in FIG. 2 when a transport motor 102 (refer to FIG. 6) rotates reversely. The feed roller 25 feeds a sheet 12 supported in the feed tray 20 rearward toward a transport path 65 (described later).

The sheet 12 fed toward the transport path 65 is transported along the transport path 65 in a transport direction 16 shown by an arrowed one-dot chain line in FIG. 2. The sheet 12 is transported from the feed tray 20 in the transport direction 16 toward the transport roller pair 54 disposed at the transport path 65.

Transport Path 65

As shown in FIG. 2, the printer 11 defines therein the transport path 65 along which the sheet 12 travels. The transport path 65 is a space defined by the guide members 18 and 19 which face each other with a predetermined gap therebetween and a space defined by the recording unit 24 and the platen 42.

The transport path 65 includes a curved path portion and a straight path portion. The curved path portion extends upward at the rear of the printer 11 to form a U-turn. The straight path portion extends from the transport roller pair 54, via the recording unit 24, to the discharge tray 21. In this embodiment, the transport roller pair 54 and the discharge roller pair 55 are disposed at the straight path portion of the transport path 65.

The transport path 65 may not necessarily include the curved path portion and the straight path portion as shown in FIG. 2. For example, the transport path 65 may be entirely straight.

Transport Roller Pair 54 and Discharge Roller Pair 55

As shown in FIG. 2, a roller pair, e.g., a transport roller pair 54, is disposed at the straight path portion of the transport path 65. The transport roller pair 54 includes a transport roller 60 and a pinch roller 61 which face each other. The transport roller 60 is driven by the transport motor 102 (refer to FIG. 6). The pinch roller 61 rotates as the transport roller 60 rotates.

A second roller pair, e.g., a discharge roller pair 55, is disposed at the transport path 65 and downstream of the transport roller pair 54 in the transport direction 16. The discharge roller pair 55 includes a discharge roller 62, as an example of a drive roller, and a spur 63 opposing the discharge roller 62. The discharge roller 62 is driven by the transport motor 102 (refer to FIG. 6). The spur 63 rotates as the discharge roller 62 rotates.

The transport roller pair 54 and the discharge roller pair 55 pinch and transport a sheet 12.

The transport roller 60 and the discharge roller 62 are rotatable in a direction to transport a sheet 12 in the transport direction 16 and in a direction opposite to the transport direction 16. In the following description, when the transport roller 60 and the discharge roller 62 rotate in a direction to transport a sheet 12 in the transport direction 16, this rotation is referred to as forward rotation. When the transport roller 60 and the discharge roller 62 rotate in a direction opposite to the forward rotation direction, this rotation is referred to as reverse rotation.

Recording Unit 24

As shown in FIG. 2, the recording unit 24 is deposed at the straight path portion of the transport path 65. In this embodiment, the recording unit 24 is disposed at the straight path portion and between the transport roller pair 54 and the discharge roller pair 55.

The recording unit 24 is disposed above the platen 42 to face the platen 42. The platen 42 supports from below a sheet 12 transported by the transport roller pair 54.

Figure 7:
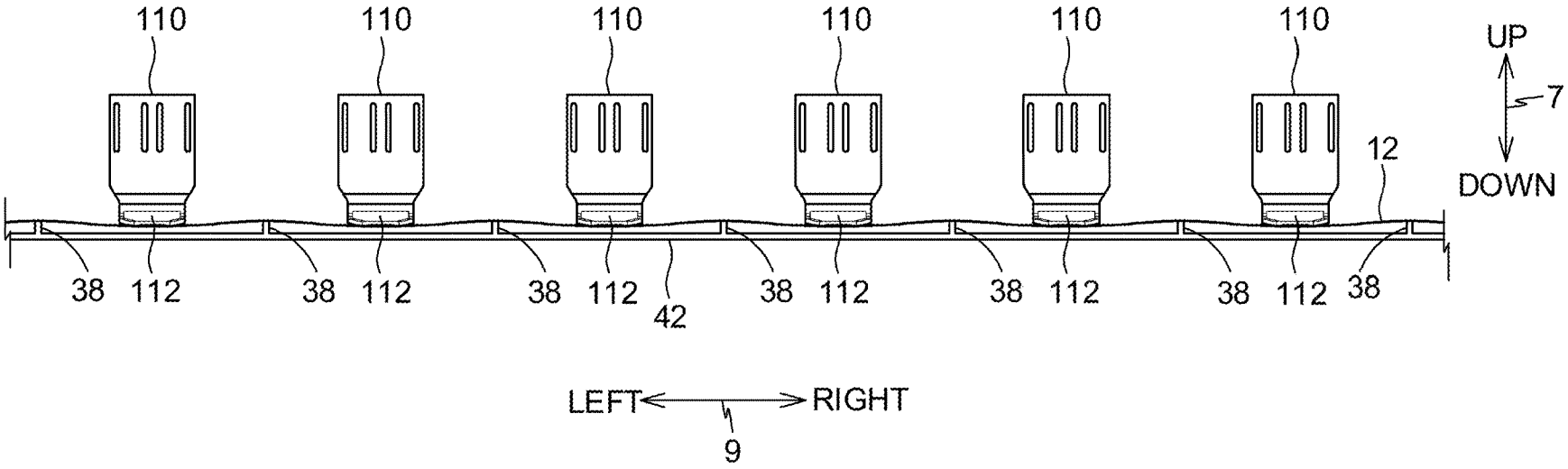
FIG. 7 is a sectional view of contact members and a platen of the printer, taken along a line IV-IV of FIG. 2

As shown in FIG. 7, the platen 42 includes, on its upper surface, a plurality of ribs 38. Each rib 38 extends in the front-rear direction 8. The ribs 38 are arranged at intervals in the left-right direction 9. A sheet 12 is supported on upper ends of the ribs 38.

As shown in FIG. 2, the recording unit 24 includes a carriage 23 and a recording head 39.

Figure 3:
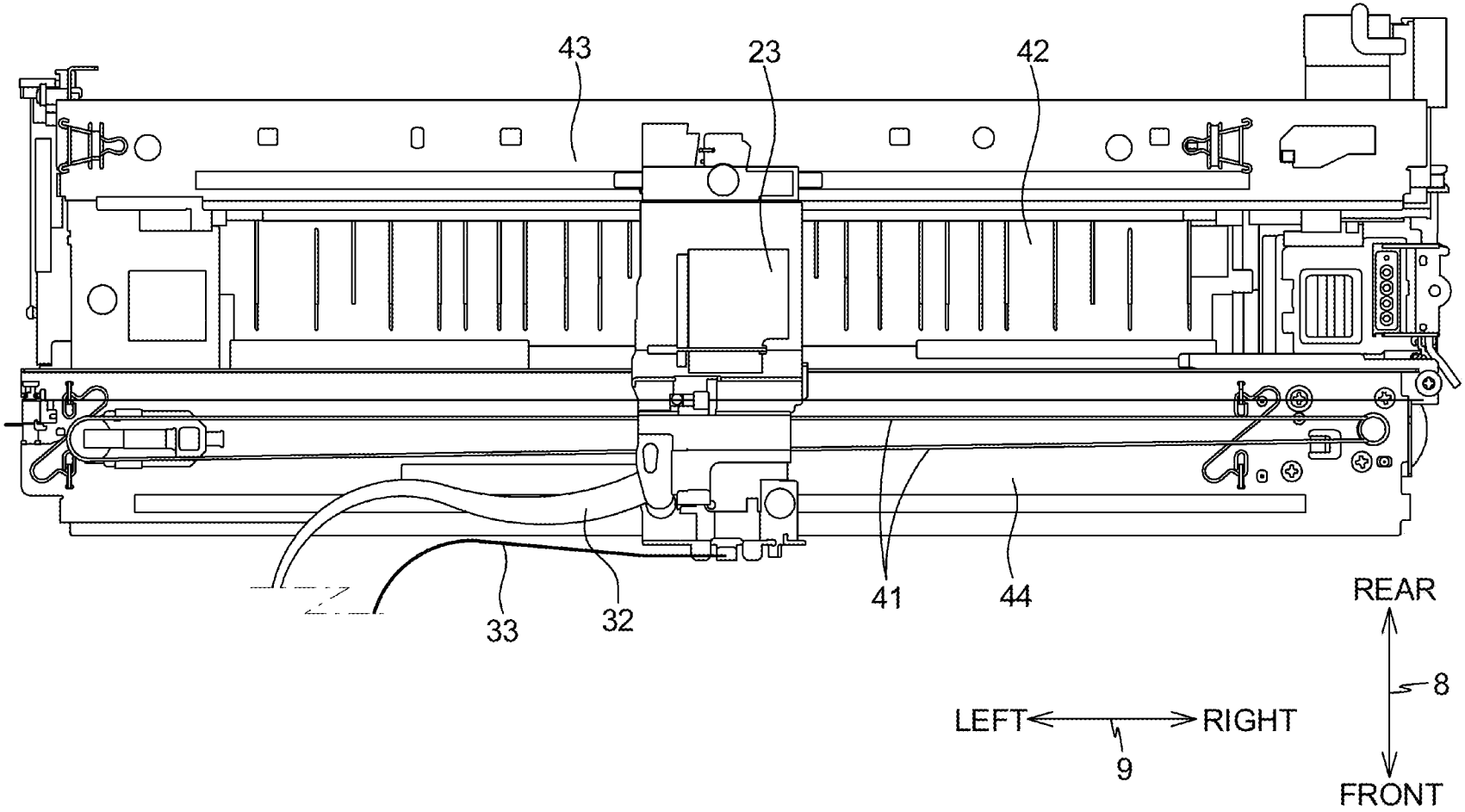
FIG. 3 is a plan view of a carriage and guide rails of the printer.

As shown in FIG. 3, an ink tube 32 and a flexible flat cable 33 extend from the carriage 23. The ink tube 32 supplies ink from an ink cartridge to the recording head 39. The flexible flat cable 33 electrically connects the recording head 39 and a control board on which the controller 130 (refer to FIG. 6) is mounted.

The carriage 23 is supported by guide rails 43 and 44. The guide rails 43 and 44 are spaced from each other in the front-rear direction 8 and extend in the left-right direction 9. The carriage 23 is connected to a known belt mechanism 41 disposed at the guide rail 44. The belt mechanism 41 is driven to circulate by a carriage motor 103 (refer to FIG. 6). When the belt mechanism 41 circulates, the carriage 23 moves in the left-right direction 9. Instead of in the left-right direction 9, the carriage 23 may move in a direction which is parallel to an imaginary surface (a horizontal surface in this embodiment) extending in the front-rear direction 8 and in the left-right direction 9 and which is orthogonal to the transport direction 16.

As shown in FIG. 2, the recording head 39 is mounted on the carriage 23. The recording head 39 includes a plurality of sub-tanks (not shown), a plurality of nozzles 40, and an ink passage (not shown), and a piezoelectric element 50 (refer to FIG. 6).

Ink is supplied to the sub-tanks from the ink cartridge (not shown) and an ink tank (not shown). The nozzles 40 are open to a lower surface of the recording head 39. The ink passage connects the sub-tanks and the nozzles 40. The piezoelectric element 50 shown in FIG. 6 deforms a portion of the ink passage to eject ink droplets from a corresponding nozzle 40. The piezoelectric element 50, when energized by the controller 130 (refer to FIG. 6), operates to eject ink droplets from a corresponding nozzle 40. While the carriage 23 moves, the recording head 39 ejects ink droplets onto a sheet 12 supported on the platen 42, thereby recording an image on the sheet 12.

Contact Members 110

As shown in FIG. 2, the contact members 110 are disposed at the transport path 65 and upstream of the nozzles 40 in the transport direction 16.

As shown in FIG. 7, the contact members 110 are arranged at intervals in the left-right direction 9. Although, in this embodiment, there are six contact members 110, a desired number of contact members 110 may be provided. The contact members 110 may be independent from each other or connected to each other.

As shown in FIG. 2, each contact member 110 is attached, at its upper end 111, to the guide rail 43 using a known fitting means. Each contact member 110 includes a curved portion extending downward and frontward from the upper end 111. Each contact member 110 extends adjacent to a position upstream of the most upstream one of the nozzles 40 in the transport direction 16. A lower end portion 112 of each contact member is located upstream of the nozzles 40 and downstream of the transport roller pair 54 in the transport direction 16. Each contact member 110 extends toward the platen 42 in the up-down direction 7. The lower end portion 112 of each contact member 110 in the transport direction 16 is contactable with an upper surface of a sheet 12 supported on the platen 42.

As shown in FIG. 7, each rib 38 disposed at the platen 42 is located between two adjacent contact members 110 in the left-right direction 9. An upper end of each rib 38 is above a lower end of the lower end portion 112 of each contact member 110. Thus, a sheet 12 supported by the ribs 38 and contacted by the lower end portions 112 of the contact members 110 is formed into a corrugated shape in the left-right direction 9. The ribs 38 and the contact members 110 form the sheet 12 into a corrugated shape in the left-right direction 9.

The printer 11 may not include the contact members 110. The contact members 110 are optional.

Sensor 120

As shown in FIG. 2, the sensor 120 is disposed at the transport path 65 and upstream of the transport roller pair 54 in the transport direction 16. A known sensor may be used as the sensor 120 to detect a sheet 12 present at the position of the sensor 120. A sheet 12 fed by the feeder 15 passes the sensor 120 and reaches the transport roller pair 54. The sensor 120 is configured to output to the controller 130 (refer to FIG. 6) one of a high-level signal and a low-level signal (e.g., a low-level signal in this embodiment) in response to a sheet present at the position of the sensor 120. On the other hand, the sensor 120 is configured to output to the controller 130 the other of a high-level signal and a low-level signal (e.g., a high-level signal in this embodiment) in response to a sheet not present at the position of the sensor 120.

Rotary Encoder 121

As shown in FIG. 2, the printer 11 includes a known rotary encoder 121 which generates pulse signals in response to rotation of the transport roller 60. The rotary encoder 121 includes an encoder disk 123 and an optical sensor 124. The encoder disk 123 rotates as the transport roller rotates 60. The optical sensor 124 reads the rotating encoder disk 123 to generate pulse signals, and outputs generated pulse signals to the controller 130. Alternatively, the rotary encoder 121 may generate pulse signals in response to the rotation of the transport motor 102. In this case, the encoder disk 123 is attached to a shaft of the transport motor 102.

Drive Transmission Mechanism 70

As shown in FIG. 6, a drive transmission mechanism 70 transmits a drive force of the transport motor 102 to the feed rollers 25, the transport roller 60, and the discharge rollers 62. The drive transmission mechanism 70 selectively includes gears, pulleys, endless belts, and a planetary gear mechanism.

Figure 4B:
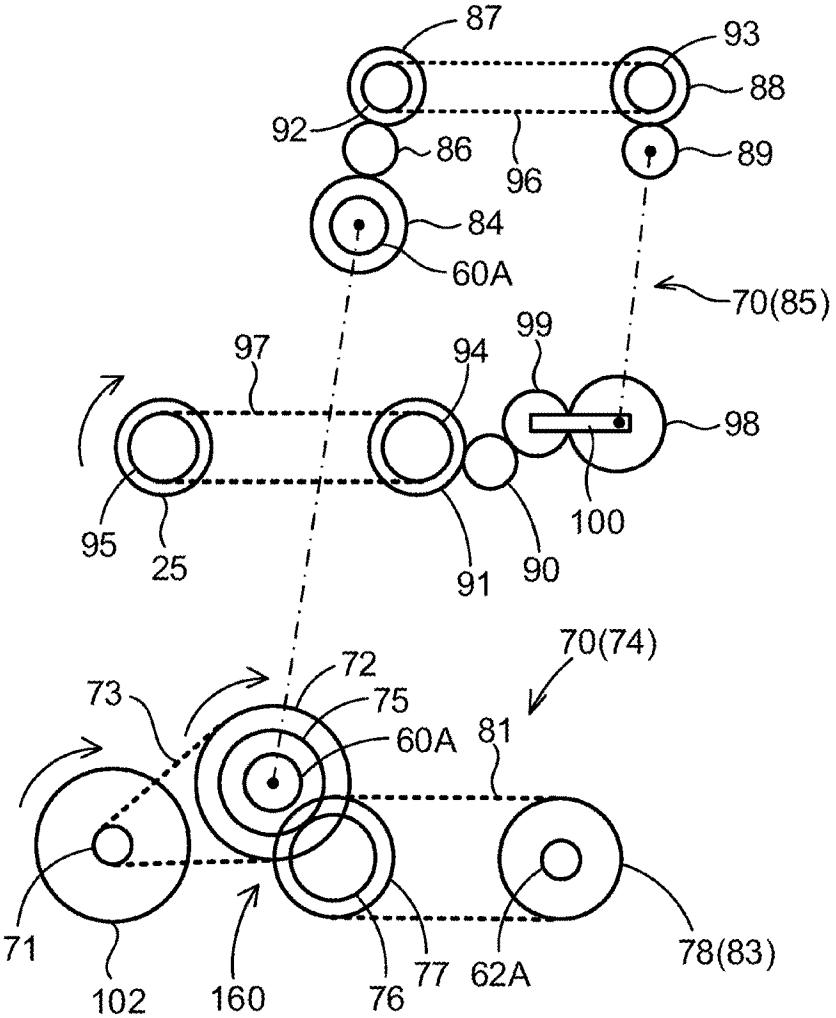
FIG. 4B is a schematic view of the transmitters in a state where the transport motor rotates reversely.
Figure 4A:
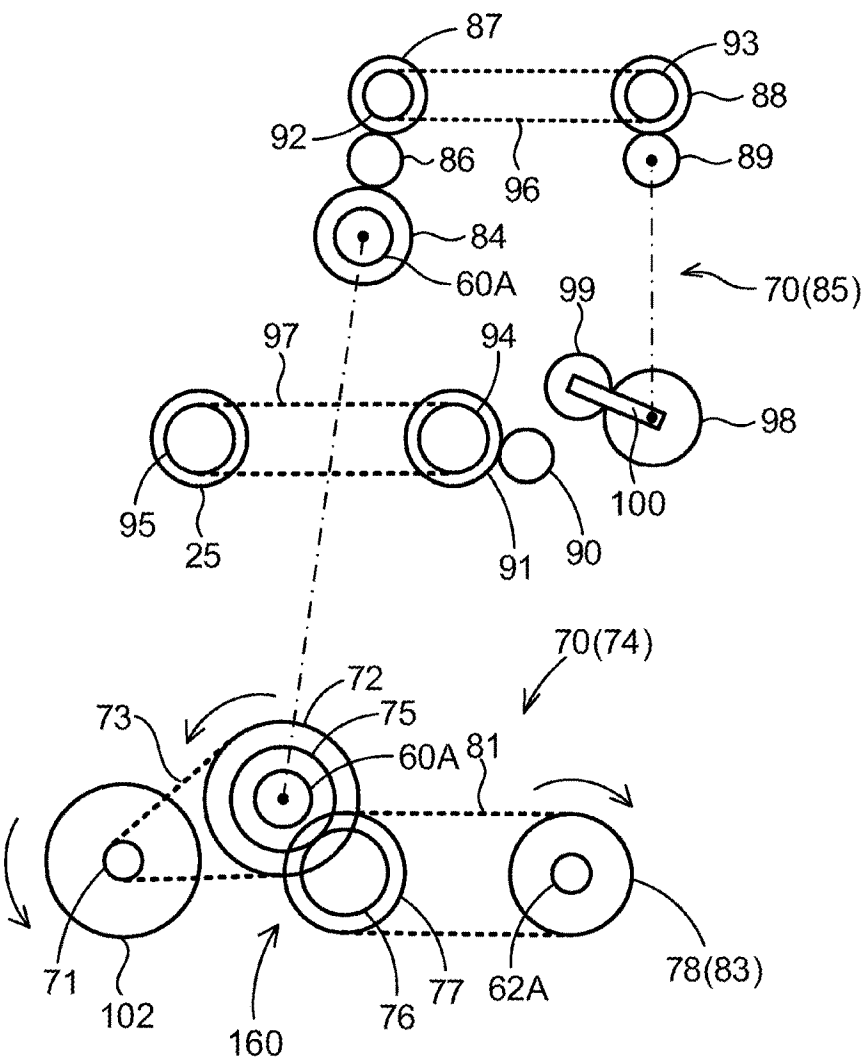
FIG. 4A is a schematic view of transmitters of the printer in a state where a transport motor rotates forward.
Figure 5:
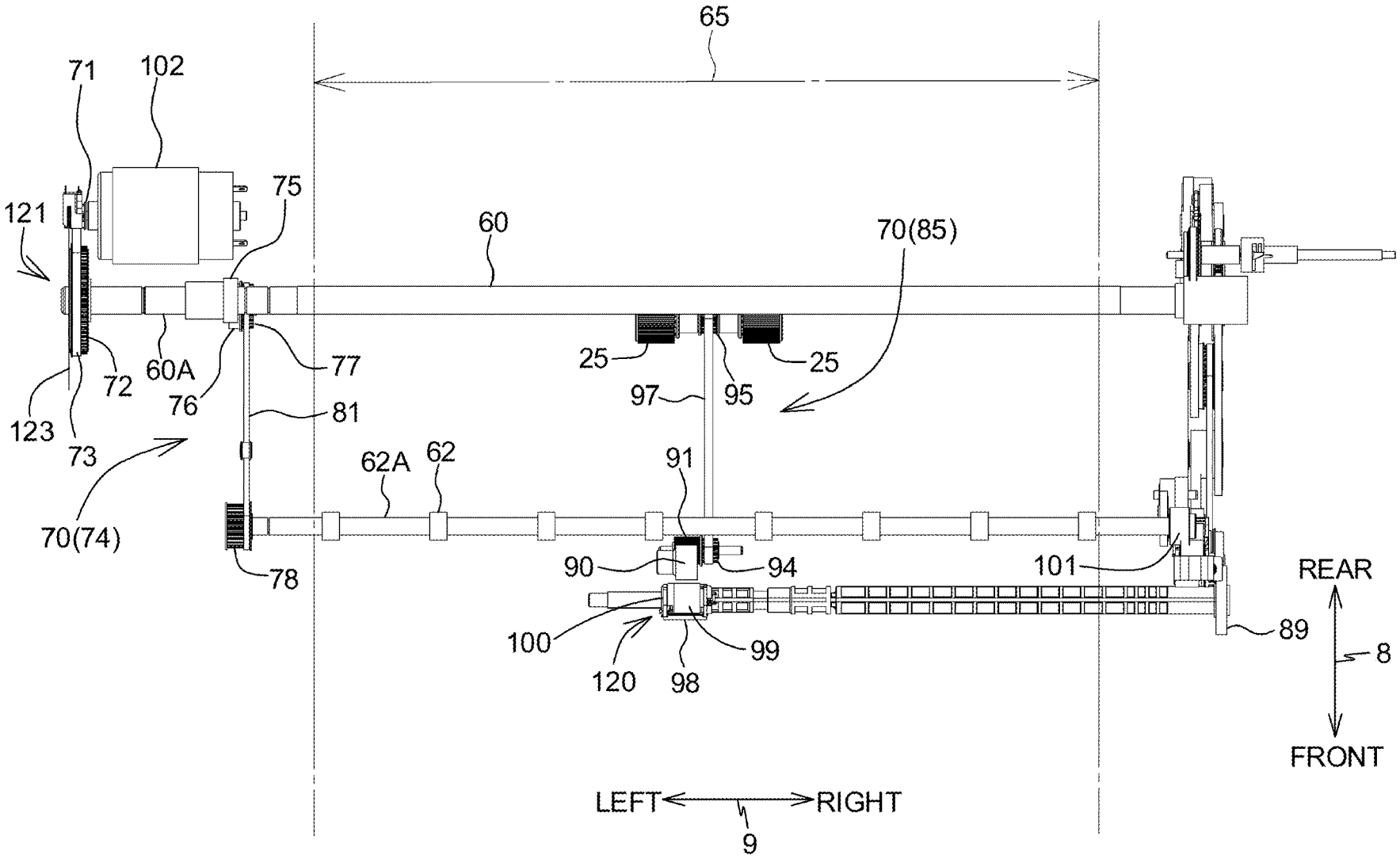
FIG. 5 is a plan view of a drive transmitting mechanism 70 and rollers of the printer.

As shown in FIGS. 4A, 4B, and 5, the drive transmission mechanism 70 includes a pulley 71 rotatable integrally with the shaft of the transport motor 102, a pulley 72 rotatable integrally with a shaft 60A of the transport roller 60, and an endless belt 73 wound around the pulleys 71 and 72. The transport roller 60 rotates forward upon receipt of the drive force of the transport motor 102 rotating forward, and rotates reversely upon receipt of the drive force of the transport motor 102 rotating reversely. The transport roller 60 rotates forward to transport a sheet 12 pinched between itself and the pinch roller 61 in the transport direction 16. The drive transmission mechanism 70 may be configured such that the transport roller 60 does not rotate reversely (stops) upon receipt of the drive force of the transport motor 102 rotating reversely.

As shown in FIG. 5, the drive transmission mechanism 70 includes transmitters 74 and 85 which transmit rotation of the transport motor 102, via the shaft 60A of the transport roller 60, to the feed rollers 25 and the discharge rollers 62. A specific structure to transmit rotation of the transport motor 102 to the feed rollers 25, transport roller 60, and discharge rollers 62 is not limited to an example described below.

Transmitter 74

FIGS. 4A, 4B, and 5 show a transmission mechanism, e.g., the transmitter 74 which transmits a drive force of the transport motor 102 rotating forward, from the transport roller 60 to the discharge roller 62. As shown in FIG. 5, the transmitter 74 is disposed further to the left than the transport path 65. The position of the transmitter 74 is not limited to that shown in FIG. 5. For example, the transmitter 74 may be disposed further to the right than the transport path 65.

As shown in FIGS. 4A, 4B, and 5, the transmitter 74 includes gears 75 and 76 in mesh with each other and an endless belt 81.

The gear 75 is in mesh with the gear 76 and rotates integrally with the shaft 60A of the transport roller 60. The gear 76 and the pulley 77 rotate coaxially and integrally with each other.

The pulley 78 is attached to an outer circumference of a shaft 62A of the discharge roller 62. The pulley 78 is rotatable about the shaft 62A. The discharge roller 62 is rotatable in response to rotation of the pulley 78. The pulley 78 includes a one-way clutch 83. When forward rotation of the transport motor 102 is transmitted to the one-way clutch 83, the one-way clutch 83 causes the discharge roller 62 to rotate integrally with the pulley 78. The one-way clutch 83 transmits forward rotation of the transport motor 102 transmitted to the pulley 78 further to the shaft 62A of the discharge roller 62. In contrast, when reverse rotation of the transport motor 102 is transmitted to the one-way clutch 83, the one-way clutch 83 causes the pulley 78 to rotate idly relative to the discharge roller 62. In other words, the one-way clutch 83 does not transmit reverse rotation of the transport motor 102 transmitted to the pulley 78 further to the shaft 62A of the discharge roller 62.

The belt 81 is wound around the pulleys 77 and 78.

As shown in FIG. 4A, the transmitter 74 transmits forward rotation of the transport motor 102 from the transport roller 60 to the discharge roller 62, thereby causing the discharge roller 62 to rotate forward. The discharge roller 62 rotates forward in an arrowed direction shown outside the discharge roller 62. In contrast, as shown in FIG. 4B, the transmitter 74 does not transmit reverse rotation of the transport motor 102 from the transport roller 60 to the discharge roller 62.

When forward rotation of the transport motor 102 is transmitted, via the transmitter 74, to the discharge roller 62, the discharge roller 62 rotates in a direction to transport a sheet 12 pinched between itself and the spur 63 in the transport direction 16. Thus, the sheet 12 is discharged onto the discharge tray 21.

Transmitter 85

The transmitter 85 shown in FIGS. 4A and 4B transmits to the feed roller 25 rotation of the transport motor 102 transmitted via the shaft 60A of the transport roller 60. As shown in FIGS. 4A and 4B, the transmitter 85 includes gears 84 and 86-91, pulleys 93-95, endless belts 96 and 97, a sun gear 98, a planetary gear 99, and an arm 100.

The gear 84 rotates integrally with the shaft 60A. The gear 86 is in mesh with the gear 84. The gear 87 is in mesh with the gear 86. The gear 87 and the pulley 92 are coaxial and rotate integrally with each other. The gear 88 and the pulley 93 are coaxial and rotate integrally with each other. The gear 89 is in mesh with the gear 88. The sun gear 98 and the gear 89 are coaxial and rotate integrally with each other. The planetary gear 99 is in mesh with the sun gear 98 and contacts and moves away from the gear 90. The arm 100 is rotatably supported, at its one end, by the sun gear 98 and supports, at its other end, the planetary gear 99 rotatably about an axis of the planetary gear 99 and rotatably around the sun gear 98. When the sun gear 98 rotates, the planetary gear 99 rotates around the sun gear 98 while rotating about its axis. The gear 90 is in mesh with the gear 91. The gear 91 and the pulley 94 are coaxial and rotate integrally with each other. The pulley 95 and the feed roller 25 are coaxial and rotate integrally with each other. The belt 96 is wound around the pulleys 92 and 93. The belt 97 is wound around the pulleys 94 and 95.

As shown in FIG. 4A, upon transmission of the drive force of the transport motor 102 rotating forward to the sun gear 98, the planetary gear 99 moves away from the gear 90. Consequently, the transmitter 85 does not transmit to the feed roller 25 the drive force of the transport motor 102 rotating forward. In this case, the feed roller 25 stops.

In contrast, as shown in FIG. 4B, upon transmission of the drive force of the transport motor 102 rotating reversely to the sun gear 98, the planetary gear 99 meshes with the gear 90. Consequently, the transmitter 85 transmits to the feed roller 25 the drive force of the transport motor 102 rotating reversely. Thus, the feed roller 25 rotates to transport a sheet 12 supported in the feed tray 20 rearward toward the transport path 65.

Controller 130

As shown in FIG. 6, the controller 130 includes a control processing unit (CPU) 131, a read-only memory (ROM) 132, a random-access memory (RAM) 133, an electrically erasable programmable ROM (EEPROM) 134, and an application specific integrated circuit (ASIC) 135, which are connected to each other by an internal bus 137. The ROM 132 stores various control programs to be used by the CPU 131 for controlling various processing. The RAM 133 may be used as a storage area for temporality storing signals and data used during execution of the programs by the CPU 131 or as a workspace for processing data. The EEPROM 134 stores settings and flags that are required to be maintained after the multifunction device 10 is turned off.

The transport motor 102 and the carriage motor 103 are connected to the ASIC 135. The ASIC 135 generates a drive signal for rotating each motor and controls each motor using the generated drive signal. Each motor rotates forward or reversely in response to a drive signal transmitted from the ASIC 135. For example, the controller 130 controls the transport motor 102 to drive each roller. The controller 130 controls the carriage motor 103 to reciprocate the carriage 23.

The sensor 120 and the rotary encoder 121 are also connected to the ASIC 135. The controller 130 detects the presence of a sheet 12 at the position of the sensor 120 based on a detection signal outputted from the sensor 120. The controller 130 determines the position of a sheet 12 based on a detection signal outputted from the sensor 120 and a pulse signal outputted from the rotary encoder 121.

The piezoelectric element 50 is also connected to the ASIC 135. The piezoelectric element 50 is energized to operate by the controller 130 via a drive circuit (not shown). The controller 130 energizes the piezoelectric element 50 to eject ink droplets selectively from the nozzles 40.

In order to record an image on a sheet 12, the controller 130 executes intermittent sheet transport by controlling the transport motor 102 such that the transport roller pair 54 and the discharge roller pair 55 alternately repeat a linefeed operation for transporting the sheet 12 by a predetermined linefeed amount and stop the sheet 12. The linefeed amount of the sheet 12 may be recognized by the rotary encoder 121 counting the rotation amount of the transport roller 60. The transport motor 102 is controlled for each linefeed operation according to a data table (described later) stored in the ROM 132. The predetermined linefeed amount in a corresponding linefeed operation is determined based on the data table.

The controller 130 executes a pass recording operation while the sheet 12 is stopped by intermittent sheet transport. The controller 130 executes a pass recording operation by energizing the piezoelectric element 50 to eject ink droplets from the nozzles 40 while moving the carriage 23 (and the recording head 39) in the left-right direction 9. In a pass recording operation, the controller 130 causes ejection of ink droplets from the nozzles 40 while moving the carriage 23 (and the recording head 39) in a pass rightward or leftward. Thus, part of an image, which corresponds to a pass of the recording head 39, is recorded on the sheet 12.

An image is recorded in the entire recordable area of the sheet 12 by alternate repetition of intermittent sheet transport and a pass recording operation. The controller 130 executes image recording on a sheet 12 in multiple passes of the recording head 39.

The ROM 132 stores therein, as a data table, characteristics of the rotation speed of the transport roller pair 54 (specifically the transport roller 60) versus a time elapsed since the start of forward rotation of the transport roller pair 54 (specifically the transport roller 60). Such characteristics may be stored in the EEPROM 134. The ROM 132 and the EEPROM 134 are each an example of a memory.

Figure 9:
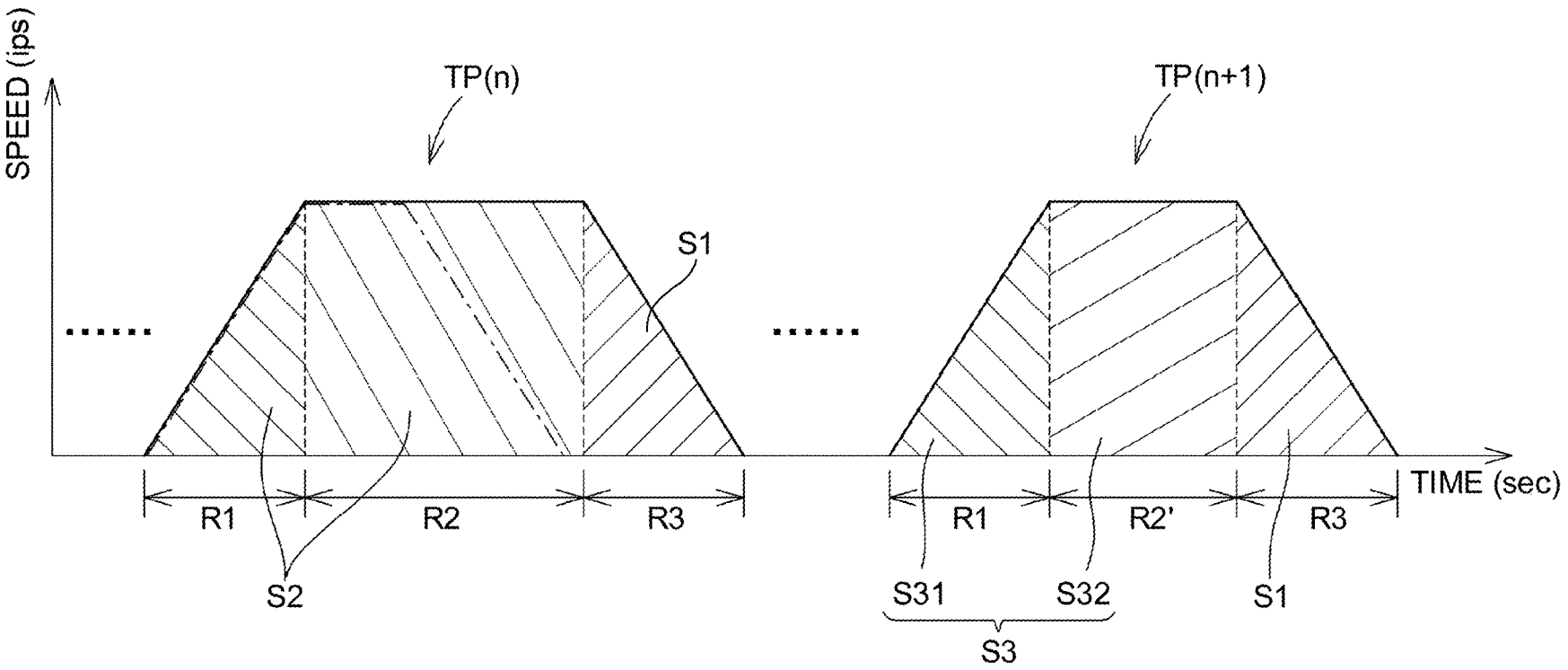
FIG. 9 is a diagram showing a characteristic of the rotation speed of a transport roller pair (specifically a transport roller) versus a time elapsed since the start of forward rotation of the transport motor in a linefeed operation.

FIG. 9 shows, as characteristic examples, characteristic TP(n) and characteristic TP(n+1). In this embodiment, each characteristic is defined by an acceleration range R1, a constant speed range R2 or R2', and a deceleration range R3. In accordance with each characteristic, the controller 130 controls the transport motor 102, using a known means such as feedback control, to accelerate, rotate at a constant speed, and decelerate the transport roller pair 54 in this order.

In this embodiment, the acceleration rate and the deceleration rate (inclinations in each characteristic), and the constant speed (a value of the vertical axis in each characteristic) are the same in these characteristics while the time period of the constant speed range (a length of the horizontal axis in each characteristic) is changed. The linefeed amount for a linefeed operation is changed by changing the time period of the constant speed range.

In the examples shown in FIG. 9, the acceleration rate, the deceleration rate, and the constant speed are the same in characteristics TP(n) and TP(n+1). However, the time period of the constant speed range R2 in characteristic TP(n) is longer than the time period of the constant speed range R2' in characteristic TP(n+1). In this case, the linefeed amount of a sheet 12 is greater when the transport roller 60 is controlled in accordance with characteristic TP(n) than when the transport roller 60 is controlled in accordance with characteristic TP(n+1). The time period of the constant speed range may be set to zero. In this case, the characteristic is defined only by the acceleration range R1 and the deceleration range R3.

The above-mentioned predetermined line feed amount is determined, for example, by the area of a segment S1 plus a segment S2 in characteristic TP(n) or by the area of a segment S1 plus a segment S3 in characteristic TP(n+1).

One characteristic, e.g., characteristic TP(n), may be stored in the ROM 132 or EEPROM 134, or plural characteristics, e.g., characteristics TP(n) and TP(n+1), may be stored in the ROM 132 or EEPROM 134. When one characteristic, e.g., characteristic TP(n) is stored in the ROM 132 or the EEPROM 134, another characteristic not stored in the memory, e.g., characteristic TP(n+1), may be calculated from characteristic TP(n) by changing the time period of the constant speed range.

The characteristics is not necessarily defined by the rotation speed of the transport roller 60 versus the elapsed time. For example, the characteristic may be defined by the rotation speed of the transport roller pair 54 (specifically the transport roller 60) versus the rotation amount of the transport roller pair 54 (specifically the transport roller 60) since the start of forward rotation.

Image Recording

Figure 8:
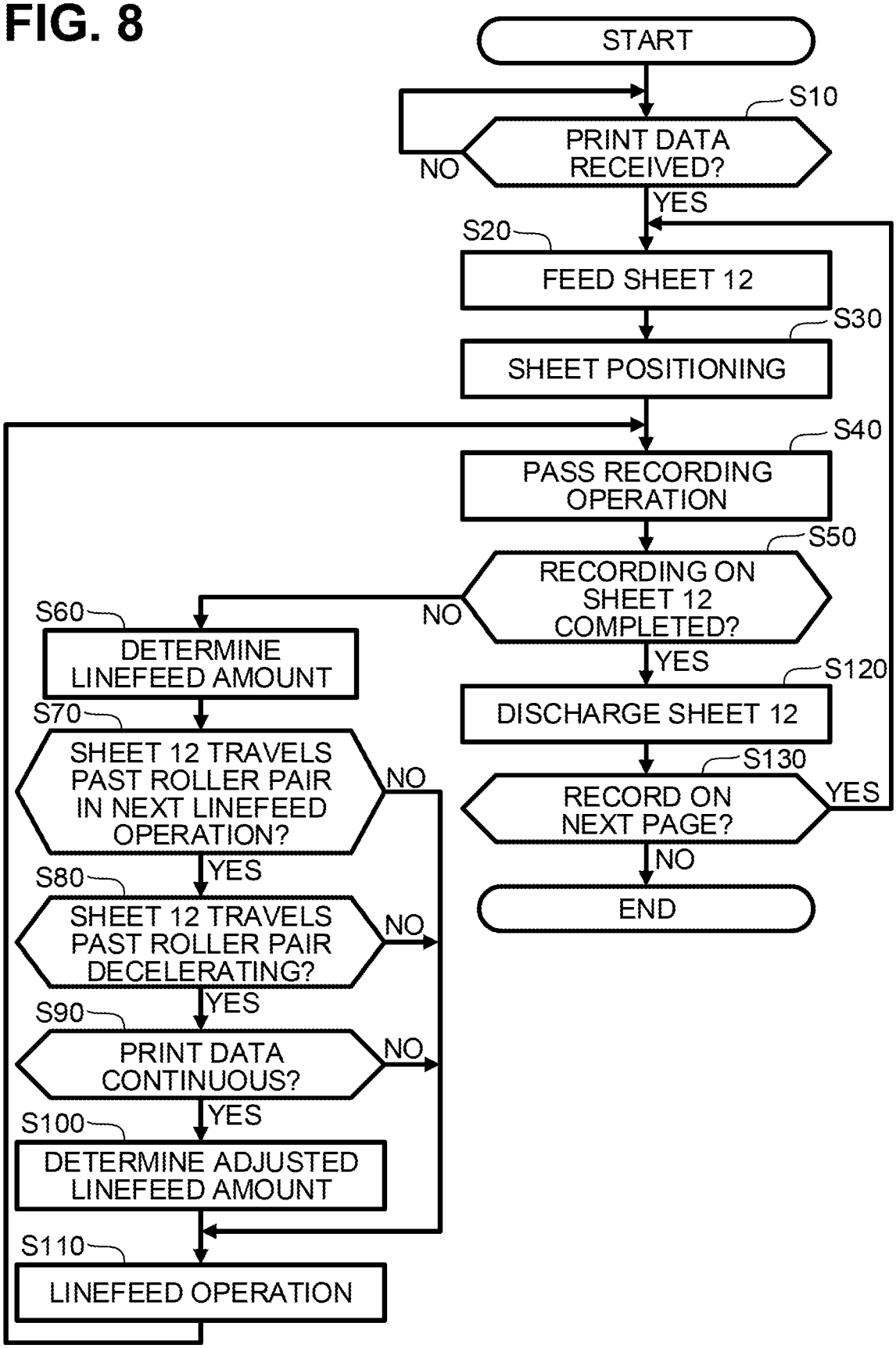
FIG. 8 is a flowchart of image recording.

Referring to a flowchart in FIG. 8, image recording in the illustrative embodiment will now be described. The CPU 131 of the controller 130 executes image recording. The steps described below may be executed by the CPU 131 which reads programs stored in the ROM 132, or by a hardware circuit mounted on the controller 130.

Print data may be sent to the controller 130 from an operation unit 17 (refer to FIG. 1) of the multifunction device 10 or from an external device connected to the multifunction device 10. The print data includes a command to start image recording control, information about the size of a sheet 12, and image data to be recorded on the sheet 12.

Upon receipt of print data (step S10), the controller 130 reversely rotates the transport motor 102. The feed roller 25 rotates to feed a sheet 12 supported in the feed tray 20 toward the transport path 65 (step S20). The fed sheet 12 contacts the transport roller pair 54 rotating reversely in response to the reverse rotation of the transport motor 102. Thus, the sheet 12 is deskewed.

Subsequently, the controller 130 executes sheet positioning (step S30). In order to position the sheet 12, the controller 130 switches the transport motor 102 from reverse rotation to forward rotation. The transport roller pair 54 rotates forward to transport the sheet 12, which is in contact with the transport roller pair 54, in the transport direction 16 and stops the sheet 12 at an image recording start position. When the sheet 12 is positioned at the image recording start position, a downstream end of an image recording area of the sheet 12 faces the most downstream one of the plurality of nozzles 40.

Subsequently, the controller 130 executes a pass recording operation on the sheet 12 (step S40). Specifically, the controller 130 stops the transport motor 102 to stop the sheet 12, and drives the carriage motor 103 to move the carriage 23 in the left-right direction 9. The controller 130 energizes the piezoelectric element 50 to eject ink droplets from the nozzles 40 while moving the carriage 23. Thus, part of an image, which corresponds to a pass of the recording head 39, is recorded on the sheet 12.

Subsequently, the controller 130 determines whether image recording on the sheet 12, as a current page, is completed based on the image data included in the print data and the size of the sheet 12 (step S50).

Upon determining that image recording on the sheet 12 is completed (step S50: Yes), the controller 130 rotates the transport motor 102 forward to rotate the discharge roller pair 55 forward. Thus, the sheet 12 is transported in the transport direction 16 and discharged onto the discharge tray 21 (step S120).

Subsequently, the controller 130 determines whether any image data of the print data is not yet recorded on the sheet 12 or, in other words, whether any image data is left to be recorded on the next page (step S130).

When no image data is left to be recorded on the next page (step S130: No), image recording based on the print data ends.

When there is image data to be recorded on the next page (step S130: Yes), the controller 130 feeds a next sheet 12 from the feed tray 20 toward the transport path 65 (step S20) and positions the sheet 12 at the image recording start position (step S30). The next sheet 12 (step S20) may be fed concurrently with discharging the previous sheet 12 (step S120).

Upon determining in step S50 that image recording on the sheet 12, as the current page, is not completed (step S50: No), the controller 130 determines a linefeed amount of the sheet 12 (step S60) for a linefeed operation to be executed next in step S110. The linefeed amount is determined based on the data table stored in the ROM 132 and the image data included in the print data. For example, the controller 130 refers to the image data. The controller 130 sets a greater linefeed amount when a distance in the transport direction 16 between part of the image recorded in the current pass recording operation (step S40) and part of the image to be recorded in the next pass recording operation (step S40) is greater.

Subsequently, the controller 130 determines whether the sheet 12 travels past the transport roller pair 54 (step S70) when the sheet 12 is transported by the linefeed amount determined in step S60 in a linefeed operation to be executed next (step S110). Specifically, the controller 130 determines whether a trailing edge (an upstream edge in the transport direction 16) of the sheet 12 is located downstream of a nip position of the transport roller pair 54 when a linefeed operation is executed next (step S110). The controller 130 makes this determination based on the position of the sheet 12 detected based on the signals outputted from the sensor 120 and the rotary encoder 121, and the distance (which is a design value) in the transport direction 16 from the sensor 120 to the nip position.

In a case where, in a linefeed operation to be executed next (step S110), the sheet 12 is transported by the linefeed amount determined in step S60 and travels past the transport roller pair 54, this "linefeed operation to be executed next" is identified by the controller 130 as an identified linefeed operation. The controller 130 identifies, out of linefeed operations to be executed in step S110, a linefeed operation causing the sheet 12 to travel past the transport roller pair 54.

Upon determining that the sheet 12 will not travel past the transport roller pair 54 (step S70: No), the controller executes a linefeed operation (step S110). In this case, in order to transport the sheet 12 by the linefeed amount determined in step S60, the controller 120 rotates the transport roller pair 54 by a rotation amount corresponding to the determined linefeed amount.

Upon determining that the sheet 12 will travel past the transport roller pair 54 (step S70: Yes), the controller 130 identifies a linefeed operation to be executed next (step S110) as a linefeed operation causing the sheet 12 to travel pas the transport roller pair 54.

Subsequently, the controller 130 determines whether the transport roller pair 60 is decelerating when the sheet 12 travels past the transport roller pair 54 (step S80). In other words, the controller 130 determines whether the sheet 12 travels past the transport roller pair 54 when the transport roller pair 60 is controlled as per the deceleration range R3 of characteristic of the data table.

Upon determining that the transport roller pair 60 is not decelerating (step S80: No) or, in other words, that the sheet 12 travels past the transport roller pair 54 when the transport roller pair 60 is controlled as per the acceleration range R1 or the constant speed range R2 of characteristic of the data table, the controller 130 executes a linefeed operation (step S110). In this case, in order to transport the sheet 12 by the linefeed amount determined in step S60, the controller 120 rotates the transport roller pair 54 by a rotation amount corresponding to the determined linefeed amount.

Upon determining that the transport roller pair 60 is decelerating (step S80: Yes) or, in other words, that the sheet 12 travels past the transport roller pair 54 when the transport roller pair 60 is controlled as per the deceleration range R3 of characteristic of the data table, the controller 130 refers to the print data.

The controller 130 determines (step S90) whether the print data recorded on the sheet 12 in the last pass recording operation (step S40) is continuous, in the transport direction 16, to the print data to be recorded on the sheet 12 in a pass recording operation to be executed next (step S40). In other words, the controller 130 determines (step S90) whether the print data (herein after referred to as previous print data) recorded on the sheet 12 in the pass recording operation (step S40) immediately before an identified linefeed operation (step S110) is continuous, in the transport direction 16, to the print data (herein after referred to as next print data) to be recorded on the sheet 12 in a pass recording operation (step S40) immediately after the identified linefeed operation.

Herein, the previous print data being continuous, in the transport direction 16, to the next print data means that the previous print data includes print data to be printed by ink ejection from the most upstream nozzle 401 (refer to FIG. 2) in the transport direction 16, and the next print data includes print data to be printed by ink ejection from the most downstream nozzle 40 in the transport direction 16.

Upon determining that the previous print data is not continuous, in the transport direction 16, to the next print data (step S90: No), the controller 130 executes a linefeed operation (step S110). In this case, in order to transport the sheet 12 by the linefeed amount determined in step S60, the controller 120 rotates the transport roller pair 54 by a rotation amount corresponding to the determined linefeed amount.

Upon determining that the previous print data is continuous, in the transport direction 16, to the next print data (step S90: Yes), the controller 130 determines an adjusted linefeed amount for the identified linefeed operation (step S100).

The identified linefeed operation (step S110) is executed by the adjusted linefeed amount instead of by the linefeed amount determined in the step S60. In this embodiment, the adjusted linefeed amount is set to a fixed amount which satisfies conditions 1 and 2 described below.

Condition 1 is that the sheet 12 does not travel past the transport roller pair 54 in the identified linefeed operation (step S110). In order to satisfy condition 1, the adjusted linefeed amount is set less than the linefeed amount determined in step S60. Specifically, the adjusted linefeed amount is set by subtracting a set linefeed amount from the linefeed amount determined in step S60. The set linefeed amount is set greater than or equal to an amount of the sheet 12 transported by the transport roller pair 54 which is decelerating in the identified linefeed operation (step S110).

For example, in a case where the transport roller 60 operates as per characteristic TP(n) in FIG. 9, the set linefeed amount is set greater than or equal to the area of the segment S1.

Condition 2 is that a sheet 12 travels past the transport roller pair 54 which is not decelerating (i.e., which is accelerating or rotating at a constant speed) in a linefeed operation (step S110) next to the identified linefeed operation. A linefeed operation (step S110) next to the identified linefeed operation is a linefeed operation to be executed after a pass recording operation (step S40) following the identified linefeed operation. In order to satisfy condition 2, the set linefeed amount is set less than or equal to an amount of the sheet 12 transported by the transport roller pair 54 which is not decelerating (i.e., which is accelerating or rotating at a constant speed) in a linefeed operation (step S110) next to the identified linefeed operation.

For example, in a case where the transport roller 60 operates as per characteristic TP(n) in FIG. 9 and then operates as per characteristic TP(n+1) in a linefeed operation (step S110) next to the identified linefeed operation, the set linefeed amount is set less than or equal to the area of the segment S3.

As described above, the adjusted linefeed amount is set (step S100) by subtracting the set linefeed amount satisfying conditions 1 and 2 from the linefeed amount determined in step S60.

In a linefeed operation (step S110) next to the identified linefeed operation, the sheet 12, when transported by the adjusted linefeed amount set as described above, travels past the transport roller pair 54 which is accelerating or rotating at a constant speed.

In this case, it may be preferable that, in a linefeed operation (step S110) next to the identified linefeed operation, the sheet 12 travels past the transport roller pair 54 when the transport roller pair 54 is accelerating than when the transport roller pair 54 is rotating at a constant speed.

In order to satisfy this preferable condition, the set linefeed amount is set to be as small as possible while satisfying condition 1.

For example, in a case where the transport roller 60 operates as per characteristic TP(n+1) in FIG. 9, the set linefeed amount is set greater than or equal to the area of the segment S1, and less than or equal to the area of the segment S3, and also is less than the area of the segment S1 plus the segment S31. In a linefeed operation (step S110) next to the identified linefeed operation, the sheet 12, when transported by the resultant adjusted linefeed amount, travels past the transport roller pair 54 which is accelerating.

After determining the adjusted linefeed amount (step S100), the controller 130 executes the identified linefeed operation (step S110). In this case, in order to transport the sheet 12 by the adjusted linefeed amount determined in step S100, the controller 130 rotates the transport roller pair 54 by a rotation amount corresponding to the adjusted linefeed amount.

After the identified linefeed operation (step S110), a pass recording operation is executed (step S40). Thereafter, the controller 130 alternately repeats a linefeed operation (step S110) and a pass recording operation (step S40) until determining that image recording is completed on the sheet 12 as the current page.

It may be preferable that the controller 130 determines the linefeed amount in step S60 such that the discharge roller 62 rotates, in a linefeed operation (step S110) next to the identified linefeed operation, by an amount which is an integral multiple of a single rotation of the discharge roller 62. However, the linefeed amount may be determined other than the above.

Upon determining that image recording is completed on the sheet 12 as the current page (step S50: Yes), the controller 130 executes the above-described steps S120 and S130. When there is no image to be recorded on the next page (step S130: No), image recording based on the print data ends.

Effects of the Embodiment

Applicants of the present application found that an error in the linefeed amount of a sheet 12 tends to be greater when the sheet 12 travels past the transport roller pair 54 which is decelerating than when the sheet 12 travels past the transport roller pair 54 which is accelerating or rotating at a constant speed.

In the above-described embodiment, upon determining that a sheet 12 will travel past the transport roller pair 54 which is decelerating (step S80: Yes), the controller 130 transports the sheet 12, in the identified linefeed operation (step S110), by the adjusted linefeed amount instead of the determined linefeed amount. This may prevent the sheet 12 from traveling past the transport roller pair 54 in a state likely to cause a relatively great error in the linefeed amount of the sheet 12. When the sheet 12 is transported by the adjusted linefeed amount in the identified linefeed operation, the sheet 12 travels past the transport roller pair 54 which is not decelerating in a linefeed operation (step S110) next to the identified linefeed operation. This allows the sheet 12 to travel past the transport roller pair 54 in a state likely to cause a relatively small error in the linefeed amount of the sheet 12.

In the above-described embodiment, upon determining that the sheet 12 travels past the transport roller pair 54 which is not decelerating (S80: No), the sheet 12 is transported, in the identified linefeed operation (step S110), by a greater linefeed amount than the adjusted linefeed amount. This may prevent extension of the time required for image recording on the sheet 12.

In the above-described embodiment, the set linefeed amount, which is a fixed amount, may simplify a linefeed operation.

An error in the linefeed amount of a sheet 12 may noticeably affect the quality of an image on the sheet 12 as a white streak or the like when print data is continuous in the transport direction 16. On the other hand, a slight error in the linefeed amount of a sheet 12 is less likely to affect the quality of an image on the sheet 12 when print data is not continuous in the transport direction 16. In the above-described embodiment, when there is a concern about the image quality (step S90: Yes), damage to the image quality may be reduced by transporting, in the identified linefeed operation, the sheet 12 by the adjusted linefeed amount instead of the determined linefeed amount. In contrast, when there is little concern about the image quality (step S90: No), extension of the time required for image recording on the sheet 12 may be prevented by transporting the sheet 12 by the determined linefeed amount in the identified linefeed operation.

An error in the linefeed amount of a sheet 12 tends to be less when the sheet 12 travels past the transport roller pair 54 which is accelerating than when the sheet 12 travels past the transport roller pair 54 which is rotating at a constant speed. In the above-described embodiment, when the sheet 12 is transported, in a linefeed operation (step S110) next to the identified linefeed operation, by the adjusted linefeed amount, the sheet 12 travels past the transport roller pair 54 which is accelerating. In this case, an error in the linefeed amount of the sheet 12 caused when traveling past the transport roller pair 54 may be reduced.

In the above-described embodiment, the adjusted line feed amount set for the sheet 12 to, in a linefeed operation next to the identified linefeed operation, travel past the transport roller pair 54 which is accelerating is greater than the adjusted linefeed amount set for the sheet 12 to, in a linefeed operation next to the identified linefeed operation, travel past the transport roller pair 54 which is rotating at a constant speed. This may prevent extension of the time required for image recording on the sheet 12.

In the above-described embodiment, it may be preferable to determine the linefeed amount in step S60 such that, in a linefeed operation next to the identified linefeed operation, the discharge roller 62 rotates by a rotation amount which is an integer multiple of a single rotation of the discharge roller 62. This may reduce an influence of the eccentricity of the discharge roller pair 55, thereby suppressing a variation in the linefeed amount of a sheet 12.

In the structure provided with the one-way clutch 83, the discharge roller pair 55 may rotate idly due to an instantaneous increase in the transport amount of a sheet 12 traveling past the transport roller pair 54. This may increase an error in the linefeed amount of the sheet 12 further than in the structure without the one-way clutch 83. However, in the above-described embodiment, a linefeed operation is executed so as to prevent a sheet 12 from traveling past the transport roller pair 54 which is decelerating. This may reduce the degree of an error in the linefeed amount of the sheet 12 traveling past the transport roller pair 54.

Transport Path 0118

Modifications

In the above-described embodiment, when a sheet 12 travels past the transport roller pair 54 which is controlled in the deceleration range R3, the controller 130 determines in step S80 that a sheet 12 travels past the transport roller pair 54 which is decelerating. In short, the controller 130 determines as "Yes" in step S80 when the transport roller 60 is controlled in the deceleration range R3 (i.e., at any point in the entire deceleration range R3).

However, the controller 130 may determine as "Yes" in step S80, not necessarily when the transport roller 60 is controlled in the entire deceleration range R3.

For example, the controller 130 may determine as "Yes" in step S80, when the transport roller 60 is controlled in a portion of the deceleration range R3. A portion of the deceleration range R3 may be a portion immediately before the stop of the transport roller 60, or a portion at or after the time when the transport roller 60 decelerates to half the constant speed.

The controller 130 may determine as "Yes" in step S80 when the transport roller 60 is controlled not only in the entire range of the deceleration range R3 but also in a portion of the range R2 immediately before the deceleration range R3. In this case, the controller 30 may determine as "Yes" in step S80 even when the transport roller 60 is not decelerating (i.e., when the transport roller 60 is rotating at a constant speed and is about to decelerate).

In the above-described embodiment, the controller 130 determines about the continuity of the print data (step S90) upon determining that the sheet 12 will travel past the transport roller pair 54 which is decelerating (step S80: Yes). However, the controller 130 may determine the adjusted linefeed amount (step S100) without executing step S90.

In the above-described embodiment, the data table stored in the ROM 132 specifies characteristics defined by the rotation speed of the transport roller 60 versus the time elapsed since the start of forward rotation of the transport motor 102. The acceleration rate and the deceleration rate (inclinations in each characteristic), and the constant speed (a value of the vertical axis in each characteristic) are the same while the time period in the constant speed range R2 is changed. However, the acceleration rate, the deceleration rate, and the constant speed in the characteristics may not be the same.

Figure 10:
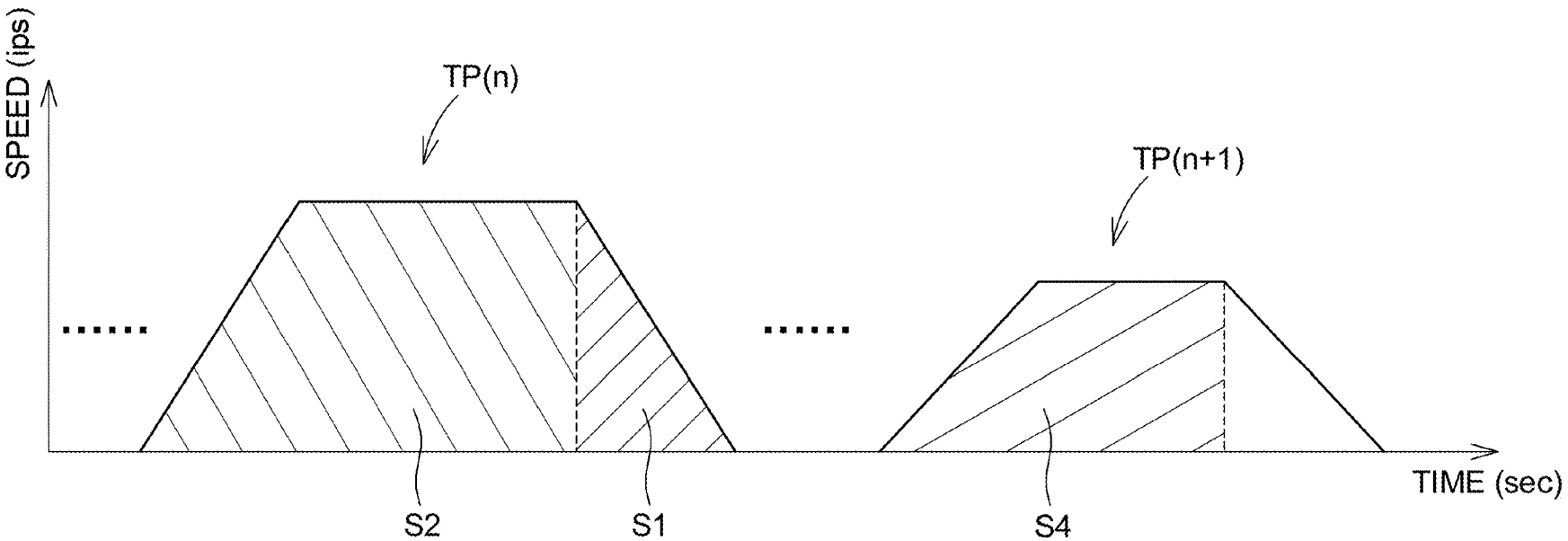
FIG. 10 is a diagram showing a characteristic of the rotation speed of a transport roller (specifically the transport roller) versus a time elapsed since the start of forward rotation of the transport motor in a linefeed operation according to a modification.

For example, FIG. 10 shows characteristic TP(n) of a linefeed operation and characteristic TP(n+1) of a linefeed operation to be executed next. The acceleration rate and the deceleration rate in characteristic TP(n+1) are less (i.e., less in inclination) than those in characteristic TP(n), and the constant speed in characteristic TP(n+1) is less (i.e., less in value of the vertical axis) than that in characteristic TP(n).

In this case, plural characteristics, which differ from each other in the acceleration rate, deceleration rate, and constant speed, may be stored in the ROM 132 or the EEPROM 134. In an example shown in FIG. 10, characteristic TP(n) and characteristic TP(n+1) are stored in the ROM 132 or the EEPROM 134. Characteristic TP(n) is an example of a first characteristic. Characteristic TP(n+1) is an example of a second characteristic.

In this case, the controller 130 calculates, in steps S60 and S100, the linefeed amount and the set linefeed amount while referring to the characteristics (e.g., a data table) stored in the ROM 132 or the EEPROM 134. For example, in order to determine the linefeed amount in step S60, the controller 130 calculates from characteristic TP(n) the area of a segment S1 plus a segment S2 (i.e., the area of all segments of characteristic TP(n)). In order to determine the adjusted linefeed amount in step S100, the controller 130 calculates the area of the segment S1 from characteristic TP(n) and the area of a segment S4 from characteristic TP(n+1) which is different from characteristic TP(n). The controller 130 sets the set linefeed amount to be greater than or equal to the area of the segment S1 and to be less than or equal to the area of the segment S4, and calculates the adjusted linefeed amount by subtracting the set linefeed amount from the area of the segment S1 plus the segment S2 calculated in step S60. The controller 130 calculates the adjusted linefeed amount based on plural characteristics (e.g., two characteristics TP(n) and TP(n+1) in this modification).

In this modification, the adjusted linefeed amount may be properly calculated even when the maximum speed, acceleration rate, and deceleration rate of the transport roller pair 54 vary depending on each linefeed operation.

In the above-described embodiment, the adjusted linefeed amount is set to a fixed amount but may be set to a variable amount. The set linefeed amount may be variably set depending on how large is the area of the segment S3 shown in FIG. 9 and how large is the area of the segment S4 shown in FIG. 10. Accordingly, the adjusted linefeed amount may be variably set.

The adjusted linefeed amount may be set as describe below on condition that a sheet 12 transported by the adjusted linefeed amount in the identified linefeed operation (step S110) does not travel past the transport roller pair 54 and that, in a linefeed operation next to the identified linefeed operation, the sheet 12 travels past the transport roller pair 54 which is not decelerating.

For example, the adjusted linefeed amount may be set such that the sheet 12 is maintained in contact with the contact members 110 from the start to completion of the linefeed operation (step S110) next to the identified linefeed operation. For example, as shown in FIG. 2, when a trailing edge of the sheet 12 upon completion of the identified linefeed operation is located at a point P1, and a downstream end in the transport direction 16 of each contact member 110 is located at point P2, the adjusted linefeed amount may be set equivalent to or less than a distance L along the transport direction 16 between the points P1 and P2. In this case, the sheet 12 is maintained in contact with the contact members 110 from the start to completion of a linefeed operation (step S110) next to the identified linefeed operation.

In this modification, the sheet 12 in contact with the contact members 110 is stable in position and orientation in a linefeed operation (step S110) next to the identified linefeed operation.

Although, in the above-described embodiment, the feed roller 25 and the transport roller 60 are driven by a common motor (e.g., transport motor 102), the feed roller 25 may be driven by a motor other than the transport motor 102.

Although, in the above-described embodiment, the multifunction device 10 is of the serial head type including the recording head 39 and the carriage 23, the multifunction device 10 may be of the line head type without the carriage 23.

Although, in the above-described embodiment, the printer 11 is an inkjet printer to record an image on a sheet 12, the printer 11 may be a thermal printer or a thermal transfer printer to record an image on a sheet 12.

In the above-described embodiment, the controller 130 of the printer 11 determines linefeed amounts and adjusted linefeed amounts.

However, a printer driver, which is a program stored in an external device connected to the multifunction device 10, may determine linefeed amounts and adjusted linefeed amounts.

The printer driver, which may be stored in a memory (e.g., a hard disk or a ROM) of an external device, is retrieved from the memory by a RAM of the multifunction device 10, and is executed by a controller (e.g., a CPU) of the multifunction device 10. Upon receipt of a print command by a user from the external device, the print driver generates print data based on image data, the number of sheets to be printed, the sheet size, and the like. The print driver sends the generated print data to the multifunction device 10.

The printer driver generates based on design data of the multifunction device 10, such as information on the number and layout of the nozzles 40, information on the position of the transport roller pair 54, and the above-described data table of the transfer roller pair 54. The generated print data includes image data to be recorded on a sheet 12 in pass recording operations, and linefeed amounts by each of which a sheet 12 is transported in a corresponding linefeed operation between adjacent pass recording operations. The printer driver determines a linefeed amount based on image data to be recorded on a sheet 12 in a corresponding pass recording operation. In an identified linefeed operation which causes the sheet 12 to travel past the transport roller pair 54 which is decelerating, the printer driver replaces the determined linefeed by an adjusted linefeed amount. The adjusted linefeed amount is set as described in the above-described embodiment and the modification. Thus, the print data generated by the printer driver includes image data to be recorded on the sheet 12 in pass recording operations, and linefeed amounts (partly adjusted linefeed amounts) each for a corresponding linefeed operation between adjacent pass recording operations.

The controller 130 of the multifunction device 10 obtains print data generated by the print driver and executes a pass recording operation and a linefeed operation based on the print data, but does not execute processing (steps S60, S70, S90, S100, and S110) for determining a linefeed amount and an adjusted linefeed amount. This is because the print driver executes the processing equivalent to these steps when generating the print data. Therefore, the controller 130 transports a sheet 12 based on the linefeed amounts and adjusted linefeed amounts included in the print data.

In this modification, the printer driver sends to the multifunction device 10 the print data for causing the controller 130 to execute the processing described in the above-described embodiment, thereby achieving similar effects as those achieved by the above-described embodiment.

What is claimed is:

1. An image recording apparatus comprising:

a roller pair configured to pinch and transport a sheet;

a recording head; and a controller configured to:

determine, based on print data, a linefeed amount by which the sheet is transported by the roller pair between corresponding two adjacent passes of the recording head;

execute image recording on the sheet by alternative repeating a linefeed operation in which the controller causes the roller pair to rotate by the determined linefeed amount to transport the sheet in a transport direction, and a pass recording operation in which the controller causes the roller pair to stop and the recording head to perform a pass and to record part of an image on the sheet;

identify, out of a plurality of linefeed operations, a linefeed operation that would cause the sheet to travel past the roller pair in the event that the roller pair rotates by the determined linefeed amount;

determine whether the identified linefeed operation would cause the sheet to travel past the roller pair while the roller pair is decelerating; and upon determining that the identified linefeed operation would cause the sheet to travel past the roller pair while the roller pair is decelerating, determine for the identified linefeed operation an adjusted linefeed amount to replace the determined linefeed amount, such that the sheet to be transported by the adjusted linefeed amount in the identified linefeed operation does not travel past the roller pair and that the sheet to be transported, in a linefeed operation next to the identified linefeed operation, travels past the roller pair while the roller pair is not decelerating.

2. The image recording apparatus according to claim 1, wherein the controller determines the adjusted linefeed amount by subtracting a set linefeed amount from the determined linefeed amount for the identified line feed operation, and wherein the set linefeed amount is greater than or equal to an amount of the sheet to be transported during deceleration of the roller pair in the identified linefeed operation, and the set linefeed amount is less than or equal to an amount of the sheet to be transported during non-deceleration of the roller pair in the linefeed operation next to the identified linefeed operation.

3. The image recording apparatus according to claim 1, further comprising a memory storing a first characteristic of a rotation speed of the roller pair versus an elapsed time or a rotation amount since the roller pair starts rotating in the identified linefeed operation, and a second characteristic of a rotation speed of the roller pair versus an elapsed time or a rotation amount since the roller pair starts rotating in the linefeed operation next to the identified linefeed operation, wherein the controller is configured to calculate the adjusted linefeed amount based on the first characteristic and the second characteristic.

4. The image recording apparatus according to claim 1, wherein the controller is configured to determine, for the identified linefeed operation, the adjusted linefeed amount to replace the determined linefeed amount when print data recorded on the sheet in a pass recording operation immediately before the identified linefeed operation is continuous to print data to be recorded on the sheet in a pass recording operation immediately after the identified linefeed operation.

5. The image recording apparatus according to claim 1, wherein the controller is configured to perform the identified linefeed operation using the determined linefeed amount when print data recorded on the sheet in a pass recording operation immediately before the identified linefeed operation is not continuous to print data to be recorded on the sheet in a pass recording operation immediately after the identified linefeed operation.

6. The image recording apparatus according to claim 1, wherein the controller is configured to accelerate, rotate at a constant speed, and decelerate the roller pair in this order in each linefeed operation, and wherein the sheet to be transported, in the linefeed operation next to the identified linefeed operation, by the adjusted linefeed amount travels past the roller pair while the roller pair is accelerating.

7. The image recording apparatus according to claim 1, further comprising a contact member disposed downstream of the roller pair in the transport direction to be contactable with the sheet, wherein the adjusted linefeed amount is determined such that the sheet is maintained in contact with the contact member from start to completion of the line feed operation next to the identified linefeed operation.

8. The image recording apparatus according to claim 1, further comprising a contact member disposed downstream of the roller pair in the transport direction to be contactable with the sheet, wherein the adjusted linefeed amount is determined such that, in the line feed operation next to the identified linefeed operation, the sheet travels in the transport direction by up to a distance between an upstream edge of the sheet located upon completion of the identified linefeed operation and the contact member.

9. The image recording apparatus according to claim 1, further comprising a drive roller disposed downstream of the roller pair in the transport direction and configured to be driven to rotate, wherein the controller is configured to rotate, in the linefeed operation next to the identified linefeed operation, the drive roller by an amount which is an integral multiple of a rotation of the drive roller.

10. The image recording apparatus according to claim 1, further comprising:

a second roller pair disposed downstream of the roller pair in the transport direction and configured to pinch and transport the sheet; and a transmitter configured to transmit rotation of the roller pair to the second roller pair, the transmitter including a one-way clutch configured to transmit forward rotation of the roller pair to the second roller pair and to not transmit reverse rotation of the roller pair to the second roller pair.

11. The image recording apparatus according to claim 1, wherein the controller is further configured to:

upon determining that the identified linefeed operation would cause the sheet to travel past the roller pair while the roller pair is not decelerating, perform the identified linefeed operation without replacing the determined linefeed amount with the adjusted linefeed amount.

12. The image recording apparatus according to claim 1, wherein the roller pair is located upstream of the recording head along a transport path of the image recording apparatus.

13. A printer driver executable on an external device communicatively connected to an image recording apparatus, the printer driver being executable to:

generate print data which includes image data to be recorded on a sheet by passes of a recording head of the image recording apparatus, and linefeed amounts by each of which the sheet is transported by a roller pair of the image recording apparatus between corresponding previous and next passes of the recording head;

determine each of the linefeed amounts based on image data for a corresponding next pass of the recording head;

identify, out of a plurality of linefeed operations, a linefeed operation that would cause the sheet to travel past the roller in the event that the roller pair rotates by the determined linefeed amount;

upon determining that the identified linefeed operation would cause the sheet to travel past the roller pair while the roller pair is decelerating, replace for the identified linefeed operation a determined linefeed amount by an adjusted linefeed amount; and determine the adjusted linefeed amount such that the sheet to be transported by the adjusted linefeed amount in the identified linefeed operation does not travel past the roller pair and that the sheet to be transported in a linefeed operation next to the identified linefeed operation travels past the roller pair while the roller pair is not decelerating.

14. The printer driver of claim 13, wherein the print data, the determined linefeed amount, and the adjusted linefeed amount are transmitted from the external device to the image recording apparatus for use in recording the image data on the sheet.

15. The device of claim 13, wherein the device is further executable to:

send the print data, the determined linefeed amount, and the adjusted linefeed amount to the image recording apparatus for use in recording the image data on the sheet.

16. A method of generating print instructions useable by an image recording apparatus, the method comprising:

generating print data which includes image data to be recorded on a sheet by passes of a recording head of the image recording apparatus, and linefeed amounts by each of which the sheet is transported by a roller pair of the image recording apparatus between corresponding previous and next passes of the recording head;

determining each of the linefeed amounts based on image data for a corresponding next pass of the recording head;

identifying, out of a plurality of linefeed operations, a linefeed operation that would cause the sheet to travel past the roller pair in the event that the roller pair rotates by the determined linefeed amount;

upon determining that the identified linefeed operation would cause the sheet to travel past the roller pair while the roller pair is decelerating, replacing for the identified linefeed operation a determined linefeed amount by an adjusted linefeed amount; and determining the adjusted linefeed amount such that the sheet to be transported by the adjusted linefeed amount in the identified linefeed operation does not travel past the roller pair and that the sheet to be transported in a linefeed operation next to the identified linefeed operation travels past the roller pair while the roller pair is not decelerating.

17. The method of claim 16, further comprising sending the print data, the determined linefeed amount, and the adjusted linefeed amount to the image recording apparatus from the device for use in recording the image data on the sheet.

18. The method of claim 16, further comprising:

executing image recording on the sheet by alternately repeating a linefeed operation in which the controller causes the roller pair to rotate by the determined linefeed amount to transport the sheet in a transport direction, and a pass recording operation in which the controller causes the roller pair to stop and the recording head to perform a pass and to record part of an image on the sheet in accordance with the image data.

19. The method of claim 16, wherein generating the print data is performed at a printer driver executable at an external device communicatively connected to the image recording apparatus.

20. The method of claim 19, wherein determining each of the linefeed amounts and determining the adjusted linefeed amount is performed at the printer driver executable at an external device communicatively connected to the image recording apparatus.

21. The method of claim 16, wherein determining each of the linefeed amounts and determining the adjusted linefeed amount is performed at the image recording apparatus upon receipt of the print data.

* * * * *